United States Patent [19]

Esashi et al.

[11] 4,337,087

[45] Jun. 29, 1982

[54] MICROCRYSTALLINE THIN STRIP FOR MAGNETIC MATERIAL HAVING HIGH PERMEABILITY, A METHOD OF PRODUCING THE SAME AND ARTICLES MADE FROM THE THIN STRIP

[75] Inventors: Kiyoyuki Esashi, Higashiosaka; Hisae Minatono, Minoo, both of Japan

[73] Assignee: Sumitomo Special Metals Co. Ltd., Osaka, Japan

[21] Appl. No.: 230,953

[22] PCT Filed: May 10, 1980

[86] PCT No.: PCT/JP80/00100

§ 371 Date: Jan. 16, 1981

§ 102(e) Date: Jan. 9, 1981

[87] PCT Pub. No.: WO80/02620

PCT Pub. Date: Nov. 27, 1980

[30] Foreign Application Priority Data

May 16, 1979 [JP] Japan ..... 54/60714

[51] Int. Cl.[3] ..... C22C 38/06

[52] U.S. Cl. ..... 75/124; 148/3; 148/31.55; 75/123 L; 164/463

[58] Field of Search ..... 148/2, 3, 31.55, 104, 148/105; 75/124 F, 123 L, 123 K, 123 J; 164/46, 66.1, 463

[56] References Cited

U.S. PATENT DOCUMENTS

| | | | |
|---|---|---|---|
| 2,266,745 | 12/1941 | Efimoff | 75/124 F |
| 2,992,474 | 7/1961 | Adams et al. | 148/104 |
| 4,190,095 | 2/1980 | Bedell | 164/463 |
| 4,257,830 | 3/1981 | Tsuya et al. | 148/31.55 |
| 4,298,381 | 11/1981 | Kudo et al. | 148/31.55 |

FOREIGN PATENT DOCUMENTS

| | | |
|---|---|---|
| 51-49115 | 4/1976 | Japan . |
| 51-138517 | 11/1976 | Japan . |
| 52-123314 | 10/1977 | Japan . |
| 53-18422 | 2/1978 | Japan . |
| 54-30203 | 6/1979 | Japan . |

*Primary Examiner*—John P. Sheehan

*Attorney, Agent, or Firm*—Stevens, Davis, Miller and Mosher

[57] ABSTRACT

Microcrystalline thin strips for highly permeable magnetic material having a tensile strength of more than 35 kg/mm$^2$ and a bending fracture strain of more than $8\times10^{-3}$ and consisting of 7.0–9.6% of Si, 5.5–7.5% of Al, 0.3–3.0% of Mo, 0.3–4.0% of Ni, 0–0.5% of Ca and the remainder being substantially Fe. The thin strips are easy to produce and have high tensile strength and flexibility. Thus the thin strips can be used for a variety of magnetic materials by working the thin strips. Two examples of commercial utility of the invention include a core for a voltage or current transformer and a magnetic head core for use in recording devices.

7 Claims, 4 Drawing Figures

MICROCRYSTALLINE THIN STRIP FOR MAGNETIC MATERIAL HAVING HIGH PERMEABILITY, A METHOD OF PRODUCING THE SAME AND ARTICLES MADE FROM THE THIN STRIP

TECHNICAL FIELD

The present invention relates to a microcrystalline thin strip for magnetic material having high permeability, and more particularly, to a microcrystalline thin strip for Si-Al-Fe series magnetic material having high permeability, and a method for producing the same and articles made from the thin strip.

BACKGROUND ART

Sendust alloys known as high permeability alloys consist of 6–12% of Si, 3–10% of Al with the remainder being substantially of Fe. Such alloys are very brittle in the cast state and readily become powder; therefore, plastic working is very difficult and the cutting and grinding of these alloys must be conducted very carefully which renders such operations highly expensive. Various Sendust multi-element alloys (abbreviated as Sendust series alloys hereinafter) in which various other elements are contained in order to improve the mechanical or magnetic properties of the above described Si-Al-Fe ternary Sendust alloys, have been known, and it has been disclosed in Japanese Patent Laid-Open Application No. 123,314/77 that Sendust series alloys containing a total amount of not more than 7.0% of at least one element selected from the group consisting of V, Nb, Ta, Cr, Mo, W, Ni, Co, Cu, Ti, Mn, Ge, Zr, Sb, Sn, Be, B, Bi, Pb, Y, and rare earth elements are excellent in magnetic properties while having a high hardness and abrasion resistance, and therefore, these alloys are used for magnetic head cores of magnetic audio and video recordings.

According to the above described laid-open application, these Sendust series alloys have a high hardness but are very brittle. Therefore, forging and rolling are difficult, so the manufacture of a thin sheet-shaped core constructing the magnetic head relies upon mechanical cutting of a cast ingot. However, in the manufacturing process, fine cracks and notches are formed. Such cracks and notches lead to the great problem of poor yield for the product. A method for simply producing thin ribbon-shaped Sendust series alloys without causing such difficulties in mechanical working has been proposed. This method for producing Sendust series alloys is characterized in that a Sendust series molten alloy in a crucible is ejected onto the surface of a cooling substance moving in a constant direction at a rate of more than 1 m/sec from a nozzle to obtain a ribbon-shaped solidified Sendust series alloy, and the properties of ribbon-shaped Sendust series alloys consisting of 83.7% of Fe, 9.2% of Si, 5.6% of Al, and 1.5% of Y, as well as the properties of ribbon-shaped Sendust series alloys consisting of 84.0% of Fe, 9.0% of Si, 5.0% of Al, 1.0% of Al, 0.8% of Ti and 0.2% of Zr shown and there has been described with the effective permeability of these alloys in 100 KHz being 1,170 and 1,200 respectively.

The production method proposed in the above described laid-open application is one belonging to a category known as a usual method of quenching a molten metal wherein a molten metal is ejected onto a moving cooling surface of a cooling substance from a nozzle to quench and solidify the molten metal to obtain an amorphous or microcrystalline metal thin strip, and in this method, a Sendust series alloy is used as a molten metal.

The inventors have found that when a Sendust series alloy thin strip containing at least one element selected from the group consisting of V, Nb, Ta, Cr, Mo, W, Ni, Co, Cu, Ti, Mn, Ge, Zr, Sb, Sn, Be, B, Bi, Pb, Y and rare earth elements in a total amount of not more than 7.0% disclosed in the above described laid-open application is formed by the quenching method, a major part of alloys have no satisfactory tensile strength and flexibility, and these thin strips cannot be worked and commercially used as a magnetic head, or as a core of a voltage or current transformer.

An object of the present invention is to provide a microcystalline thin strip for magnetic material having high permeability and high tensile strength as well as flexibility, in which the low tensile strength and flexibility possessed by already known microcrystalline thin strips are improved. Another object of this invention is to provide a method for producing the same thin strip and articles made from the thin strip.

DISCLOSURE OF INVENTION

The present invention can accomplish the above described objects by providing a microcrystalline thin strip, for magnetic material, having high permeability and mechanical properties and the following component compositions, a method for producing the same, and articles made from the thin strip.

1. A microcrystalline thin strip for magnetic material having high permeability which consists of 7.0–9.6% of Si, 5.5–7.5% of Al, 0.3–3.0% of Mo, 0.3–4.0% of Ni, 0–0.5% of Ca and the remainder being substantially Fe, and has a tensile strength of more than 35 kg/mm$^2$ and a bending fracture strain of more than $8\times10^{-3}$.
2. A microcrystalline thin strip for magnetic material having high permeability, a tensile strength of more than 35 kg/mm$^2$ and a bending fracture strain of more than $8\times10^{-3}$, which is obtained by ejecting a molten metal consisting of 7.0–9.6% of Si, 5.5–7.5% of Al, 0.3–3.0% of Mo, 0.3–4.0% of Ni, 0–0.5% of Ca and the remainder being substantially Fe onto the moving cooling surface of one or more cooling substances from a nozzle, and quenching and solidifying the molten metal.
3. A method for producing a microcrystalline thin strip for magnetic material having high permeability, a tensile strength of more than 35 kg/mm$^2$ and a bending fracture strain of more than $8\times10^{-3}$, by ejecting a molten metal consisting of 7.0–9.6% of Si, 5.5–7.5% of Al, 0.3–3.0% of Mo, 0.3–4.0% of Ni, 0–0.5% of Ca and the remainder being substantially Fe, onto the moving cooling surface of one or more cooling substances, from a nozzle, and quenching and solidifying the molten metal.
4. A core for a voltage or current transformer manufactured from a microcrystalline thin strip for magnetic material having high permeability which consists of 7.0–9.6% of Si, 5.5–7.5% of Al, 0.3–3.0% of Mo, 0.3–4.0% of Ni, 0–0.5% of Ca and the remainder being substantially Fe, and has a tensile strength of more than 35 kg/mm$^2$ and a bending fracture strain of more than $8\times10^{-3}$.
5. A magnetic head core manufactured from a microcrystalline thin strip for magnetic material having high permeability which consists of 7.0–9.6% of Si, 5.5–7.5% of Al, 0.3–3.0% of Mo, 0.3–4.0% of Ni, 0–0.5% of Ca and the remainder being substantially Fe, and has a tensile strength of more than 35 kg/mm$^2$ and a bending fracture strain of more than $8\times10^{-3}$.

The inventors have studied mixing various adding elements in order to improve the embrittlement of Sendust alloy or Sendust alloy series alloy thin strip produced by a method of quenching a molten metal, and the inventors have found that the addition of 0.3–3.0% of Mo and 0.3–4.0% of Ni or additionally not more than 0.5% of Ca is very effective for noticeably improving mechanical properties, such as flexibility and tensile strength, without deteriorating the critical magnetic property of high permeability of Sendust alloy. The result has led to the present invention.

BEST MODE OF CARRYING OUT THE INVENTION

Figure 1:
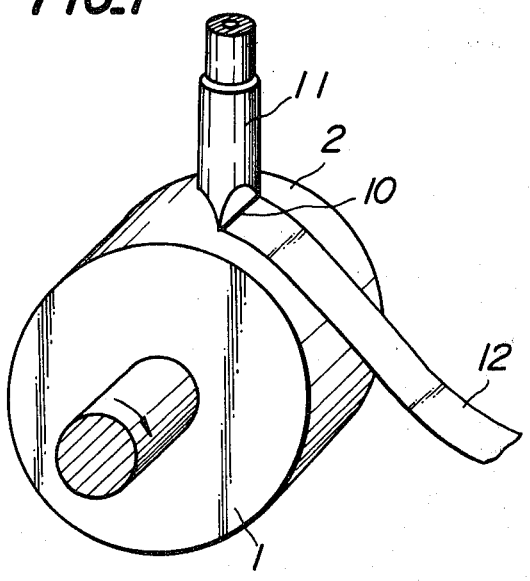
FIG. 1 is a perspective view of an apparatus for producing a thin strip which is provided with a metal rotary disc as a cooling substance.

The thin strips of the present invention can be worked and handled in a variety of steps necessary for working and manufacturing of magnetic heads or laminated or wound cores for a voltage or current transformer and the like, for example, steps of winding, drawing, grinding, insulator coating, charging into a heat treating furnace and the like, and are high in yield and low in deterioration of quality. The resulting strips have satisfactory strength and bending property so as to satisfy the requirements of commercial production.

The inventors have produced thin strips from molten metals having the component composition of Sendust alloy or various Sendust series alloys, which have been heretofore used as the magnetic material having high permeability and produced through casting, by the quenching method. The inventors have also produced thin strips of the present invention by the quenching method. The method for producing the thin strip will be explained in detail hereinafter.

The tensile strength $\sigma_B$, bending fracture strain $\epsilon_f$, Vickers hardness Hv and average crystal grain size were measured with respect to these thin strips and the results obtained are shown in the following Table 1. In this table, No. 1–13 are comparative alloy thin strips and No. 14–22 are alloy thin strips of the present invention.

The thin strips were subjected to a tensile test by means of an Instron type tensile testing machine under the conditions of a distance between gage length of 50 mm, a strain rate of $2\times10^{-3}$ min$^{-1}$, and room temperature of 20° C., and the cross-sectional area of a sample was calculated by measuring the size of the sample in the vicinity of the broken portion and the tensile strength of $\sigma_B$ described in Table 1 was obtained.

The bending fracture strain $\epsilon_f$ is shown by the following formula when the thickness of the sample ribbon is t and the minimum curvature radius of the center line of the thickness of the sample at which the bending is possible without rupturing the sample ribbon is r and this value is used for evaluating the degree of embrittlement or ductility of the ribbon. When the bending of 180° is possible, $\epsilon_f$ is 1, and when the bending is completely impossible, $\epsilon_f$ is 0.

$$\epsilon_f=(t)/(2r)$$

TABLE 1

| | Sample No. | Composition (wt %) | Tensile strength $\sigma_B$ (kg/mm$^2$) | Bending fracture strain $\epsilon_f\times10^{-2}$ | Vickers hardness Hv (25 gr) | Average crystal grain size (μm) |
|---|---|---|---|---|---|---|
| | 1 | 9.5Si—5.4Al—Fe | 23.8 | 0.46 | 464 | 15 |
| | 2 | 9.3Si—5.2Al—1.0Zr—2.0Ti—Fe | 32.7 | 0.64 | 483 | 12 |
| | 3 | 9.4Si—5.3Al—0.3Mn—2.0Ti—Fe | 17.6 | 0.48 | 514 | 12 |
| | 4 | 8.8Si—5.9Al—2.6Ge—Fe | 24.4 | 0.50 | 483 | 13 |
| | 5 | 9.6Si—5.4Al—0.5Mo—1.5Ti—Fe | 27.8 | 0.67 | 484 | 10 |
| Thin strip of | 6 | 9.4Si—5.5Al—2.0Nb—Fe | 21.0 | 0.73 | 499 | 8 |
| comparative | 7 | 9.6Si—5.4Al—0.01Co—0.5Ti—Fe | 13.5 | 0.41 | 437 | 15 |
| alloy | 8 | 9.4Si—5.3Al—0.7W—1.0Ti—Fe | 20.0 | 0.37 | 464 | 10 |
| | 9 | 9.2Si—5.2Al—1.9Ge—1.9Ti—Fe | 29.9 | 0.39 | 514 | 10 |
| | 10 | 9.6Si—5.4Al—0.3Pt—Fe | 22.0 | 0.50 | 477 | 9 |
| | 11 | 9.2Si—5.6Al—1.5Y—Fe | 31.1 | 0.67 | 516 | 10 |
| | 12 | 9.0Si—5.0Al—1.0Y—0.8Ti—Fe | 26.0 | 0.70 | 493 | 10 |
| | 13 | 9.4Si—6.2Al—1.2Mo—Fe | 42.9 | 1.08 | 464 | 8 |
| | 14 | 8.9Si—7.05Al—1.2Mo—1.0Ni—Fe | 45.0 | 1.01 | 446 | 9 |
| | 15 | 8.9Si—6.95Al—1.2Mo—1.0Ni—Fe | 54.1 | 1.13 | 446 | 9 |
| | 16 | 9.0Si—7.0Al—1.2Mo—1.0Ni—Fe | 38.1 | 1.01 | 455 | 9 |
| Thin strip of | 17 | 9.0Si—6.85Al—1.0Mo—1.0Ni—Fe | 40.8 | 0.983 | 455 | 10 |
| alloy of | 18 | 9.1Si—6.85Al—1.0Mo—1.0Ni—Fe | 38.3 | 0.955 | 446 | 10 |
| the present | 19 | 9.1Si—6.75Al—1.0Mo—1.0Ni—Fe | 41.0 | 1.01 | 473 | 9 |
| invention | 20 | 8.9Si—7.05Al—1.2Mo—1.0Ni—0.05Ca—Fe | 42.6 | 1.14 | 464 | 8 |
| | 21 | 8.9Si—7.05Al—1.2Mo—1.0Ni—0.1Ca—Fe | 53.4 | 1.04 | 455 | 7.5 |
| | 22 | 8.9Si—7.05Al—1.2Mo—1.0Ni—0.2Ca—Fe | 51.0 | 1.22 | 452 | 8 |

As seen from Table 1, in the thin strips Nos. 14–22 of the present invention, the tensile strength $\sigma_B$ is improved about 10–25 kg/mm$^2$ and the bending fracture strain $\epsilon_f$ is improved about 1.5–2 times as compared with the thin strips Nos. 1–13 which were produced by subjecting Sendust series alloys having the conventionally known component composition to the quenching method. The sample No. 13 of 9.4 Si-6.2 Al-1.2 Mo-Fe alloy thin strip contains Mo similarly to the thin strip of the present invention and possesses the same extent of excellent mechanical properties as in the thin strips of the present invention. It can be seen that the addition of a moderate amount of Mo to a Sendust alloy thin strip is very effective for improving the mechanical properties. The thin strips of the present invention are characterized in that Ni is added together with Mo.

By adding Mo to Sendust alloy, the resulting composition gets out of the composition satisfying the critical magnetostriction ($\gamma_s=0$) and magnetic anisotropy factor ($K_0=0$) of Sendust alloy, and the magnetic properties are deteriorated, but in the alloys of the present invention, $\gamma_s$ and $K_0$ are controlled by adding Ni together with Mo in the alloys of the present invention and $\gamma_s=0$ and $K_0=0$ are attained.

Furthermore, by the addition of Ca, the boiling phenomenon in the melting of the alloy is induced and the deoxidization effect is noticeably improved. It is apparent from Table 1 that the mechanical properties are not deteriorated by the addition of Ni and Ca.

The reason why Mo in the thin strips of the present invention is limited to 0.3–3.0% is that when Mo is less than 0.3%, the thin strip having excellent strength is not obtained and when Mo exceeds 3.0%, the second phase enriched in Mo and Si appears noticeably, and the permeability is considerably deteriorated. The reason why Ni is limited to 0.3–4.0% is that the high permeability is obtained within this range. The reason why Ca is limited to not more than 0.5% is that Ca of more than 0.5% deteriorates the high permeability. The reason why Si is limited to 7.0–9.6% and Al is 5.5–7.5% is that the high permeability can be attained within this range.

The production method of the present invention will be explained hereinafter.

A molten metal consisting of 7.0–9.6% of Si, 5.5–7.5% of Al, 0.3–3.0% of Mo, 0.3–4.0% of Ni, 0–0.5% of Ca, with the remainder being substantially Fe, is ejected onto the moving cooling surface of one or more cooling substances from a nozzle under vacuum or an atmosphere of air, an inert gas or the like to quench and solidify the molten metal to produce a thin strip of the present invention.

Figure 2:
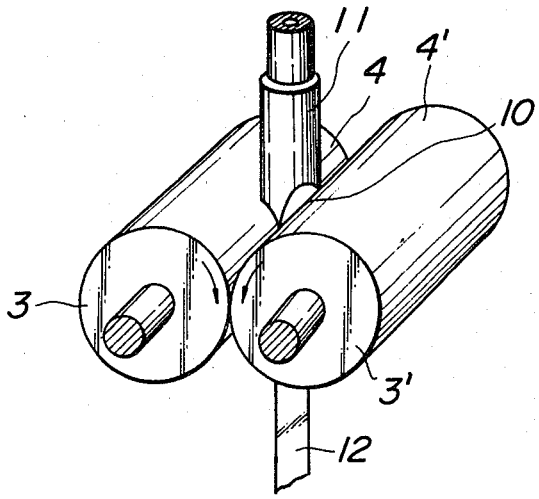
FIG. 2 is a perspective view of an apparatus for producing a thin strip which is provided with two metal rolls as a cooling substance.
Figure 3:
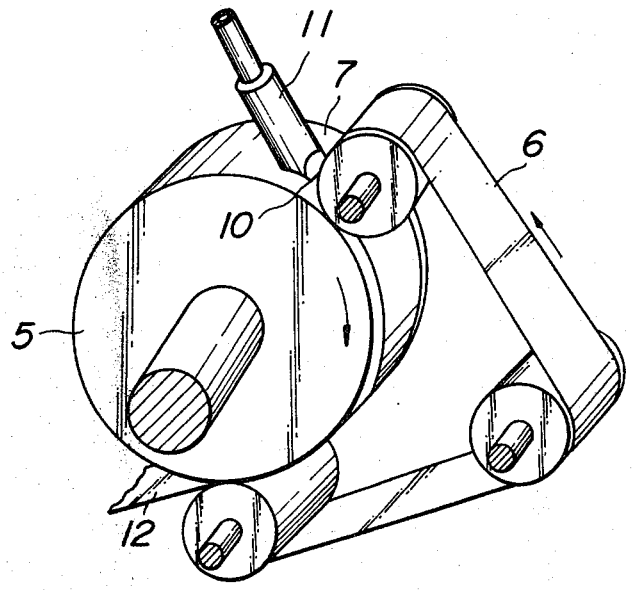
FIG. 3 is a perspective view of an apparatus for producing a thin strip which is provided with a metal rotary cylinder and a metal belt as a cooling substance.
Figure 4:
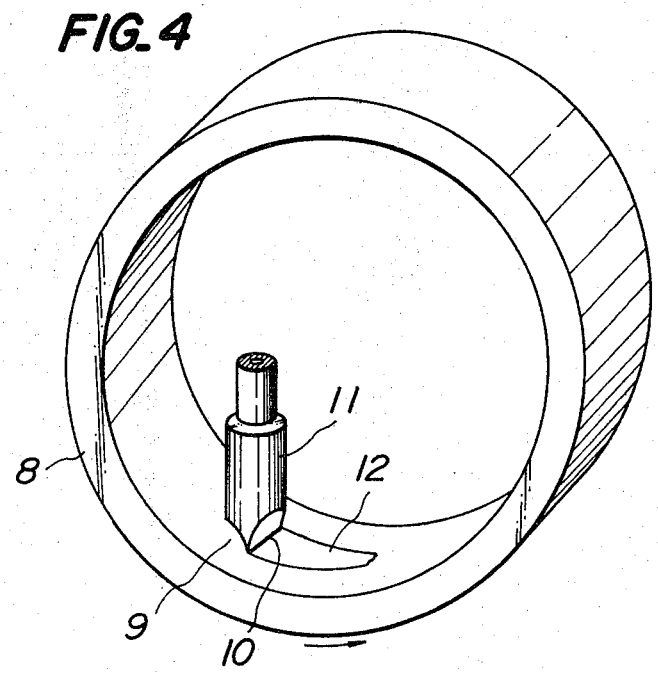
FIG. 4 is a perspective view of an apparatus for producing a thin strip which is provided with a metal rotary drum as a cooling substance.

As the above described moving cooling surface of cooling substance, use may be made of a rotating outer circumferential surface 2 of a metal rotary disc 1 as shown in FIG. 1, rotating outer circumferential surfaces 4, 4' of two metal rolls 3, 3', which are arranged in contact and parallel with each other and rotate reversely as shown in FIG. 2, an outer circumferential surface 7 of a rotating metal cylinder 5, which rotates in contact with a running metal belt 6 as shown in FIG. 3 or a rotating inner circumferential surface 9 of a metal rotary drum 8 as shown in FIG. 4 and when a molten metal 10 is ejected onto the rotating cooling surface from a nozzle 11, the molten metal 10 is quenched and solidified to form a thin strip 12.

The above described method for producing the thin strip is referred to as "a method for quenching a molten metal" and is the same as or similar to the method broadly used for producing amorphous or microcrystalline metal thin strips but it has never been known that a microcrystalline thin strip for magnetic material having high permeability, a tensile strength of more than 35 kg/mm$^2$ and a bending fracture strain of more than $8\times10^{-3}$ is produced from a molten metal having the composition of the thin strip of the present invention through the above described production method.

One embodiment of the production method of the present invention will be explained. For example, while rotating at 3,000 r.p.m., a rotary disc made of carbon steel containing 0.42% of C and 0.64% of Mn and having a diameter of 20 cm as a cooling substance, a molten metal having a composition of a thin strip of the present invention is ejected at 1,350° C. onto a rotating outer circumferential surface of the disc under an ejecting pressure of 2.0 atm from a nozzle to produce a thin strip of the present invention having a thickness of about 30 μm, a width of about 30 mm and a length of more than 5 m.

Prior Sendust alloy or Sendust series alloy cast metal is brittle and therefore is difficult in cold working. Accordingly, the alloy is produced into a dust core through powder molding or the cast metal is cut and ground into a magnetic head core. A thin continuum of well-know Sendust or Sendust series alloy obtained by the quenching method is poor in mechanical properties, such as tensile strength, bending fracture strain and the like, and the application is limited to the above described already known uses. The thin strips according to the present invention are thin in thickness and excellent in strength and flexibility while possessing the same extent of high permeability, high specific resistance, hardness and abrasion resistance as in Sendust alloy. Accordingly, the thin strips can be used for laminated or wound cores for a voltage or current transformer by subjecting the strips to press punching or winding and further to an insulating treatment except for the already known applications, such as a magnetic head core. In particular, the thin strips of the present invention usually are ribbon- or sheet-shaped bodies having a thickness of about 10 μm–100 μm and can be used as a core having low eddy current loss at a high frequency zone of a high electric resistance. The properties are far more excellent than those of a voltage or current transformer using a silicon steel sheet, and the thin strips of the present invention can constitute an advantageous voltage or current transformer having a far lower cost than the voltage or current transformer using a variety of permalloy series alloys.

The thin strips of the present invention show high permeability when subjected to the similar heat treatments applied to already known Sendust alloy or Sendust series alloys. That is, the thin strip is kept at a high temperature of 1,000°–1,200° C. for from several tens of minutes to several hours under hydrogen atmosphere or vacuum, and then gradually cooled to 550°–650° C. at a cooling rate of 50°–300° C./hr, after which the cooled thin strip is taken out of a furnace and quenched at such a cooling rate that the cooling is effected in air to form a complicated state wherein the regular-irregular lattices are mixed, and which possesses high maximum permeability, initial permeability and low coercive force.

The present invention will be explained with reference to the following examples hereinafter.

EXAMPLE 1

About 10 g of an alloy of the present invention having a composition shown in the above Table 1 or the following Table 2, was melted in a quartz tube provided at its bottom with a nozzle having a slit-like cross-sectional shape having a length of several millimeters and a width of about 200–300 μm, further heated to a temperature 40°–50° C. higher than the melting point of the alloy, and then ejected onto the outer circumferential surface of a rotating cooling disc made of cast iron or carbon steel and having a diameter of 160 mm or 400 mm at an ejection angle of 0°–10° with respect to the radial direction of the disc by a pressure of Ar gas of 1.0–2.0 atm. In this case, the distance between the tip of the nozzle and the cooling surface was kept in a sufficiently small value of 0.5–1 mm in order that the ejected fluid was not formed into droplets due to action of surface tension of the ejected fluid before the fluid reached the cooling surface. The cooling roll was rotated at 1,000–3,500 r.p.m., and various ribbon-shaped thin strips having a length of at least 5 m and a thickness of 15–70 μm were produced.

As seen from Table 1, the thin strip of the present invention has a tensile strength and a bending fracture strain remarkably higher than those of the thin strip of Sendust alloy or well-known Sendust series alloy, and further, has substantially the same high hardness as that of the thin strip of Sendust alloy or well-known Sendust series alloy.

EXAMPLE 2

About 1 g of a thin strip having an alloy composition shown in the following Table 2 according to the present invention, which was produced in the same manner as described in Example 1, was wound round an alumina ceramic bobbin having a diameter of about 20 mm, and then subjected to a heat treatment, by which the thin strip was kept at 1,100° C. for 30 minutes under a high-purity hydrogen atmosphere having a dew point of −60° C., and then gradually cooled to 600° C. at a rate of 200° C./hr in a furnace, and then the thin strip was taken out from furnace and cooled in air from 600° C. to room temperature. Then, a measuring coil was wound round the above treated thin strip, and the magnetic properties of the thin strip under direct current were measured by means of an Automatic D.C. B-H Curves Tracer to obtain a high maximum permeability μm, an initial permeability μ0.01 at 0.01 Oe, a low coercive force Hc and a magnetic induction $B_{10}$ at 10 Oe as described in Table 2, which are not inferior to those of Sendust alloy. For comparison, magnetic properties under direct current of thin strips of Sendust alloy and conventional Sendust series alloy, which have been subjected to the same heat treatment as described above, are also as shown in Table 2.

For reference, each of the alloys of the present invention, Sendust alloy and conventional Sendust series alloy was cast into a rod, and the rod was subjected to the same heat treatment as described above, except that the rod was kept at 1,100° C. for 3 hours. The specific resistance of the above treated rod is also shown in Table 2. It can be seen from Table 2 that the alloy of the present invention has a specific resistance higher than that of Sendust alloy.

TABLE 2

| | Sample No. | Composition (wt %) | Maximum permeability μm × $10^3$ | Initial permeability μ0.01 × $10^3$ | Coercive force Hc(Oe) | Saturated magnetic induction $B_{10}$ × $10^3$ (G) | Specific resistance (μΩ-cm) |
|---|---|---|---|---|---|---|---|
| | 1 | 9.5Si—5.4Al—Fe (Sendust alloy) | 120 | 85 | 0.033 | 9.0 | 98.7 |
| | 2 | 9.3Si—5.2Al—1.0Zr—2.0Ti—Fe | 5 | — | 0.75 | 9.0 | 100.1 |
| | 3 | 9.4Si—5.3Al—0.3Mo—2.0Ti—Fe | 50 | 20 | 0.04 | 10.0 | 102.3 |
| | 4 | 8.8Si—5.9Al—2.0Ge—Fe | 85 | 20 | 0.05 | 9.7 | 89.1 |
| Comparative alloy | 5 | 9.6Si—5.4Al—0.5Mo—1.5Ti—Fe | 5 | — | 0.4 | 9.5 | 97.5 |
| | 6 | 9.4Si—5.5Al—2.0Nb—Fe | 10 | 8 | 0.5 | 10.4 | 87.3 |
| | 7 | 9.6Si—5.4Al—0.01Co—0.5Ti—Fe | 60 | — | 0.042 | 10.0 | 85.0 |
| | 8 | 9.4Si—5.3Al—0.7W—1.0Ti—Fe | 100 | 30 | 0.025 | 10.0 | 90.1 |
| | 9 | 9.2Si—5.2Al—1.9Ge—1.9Ti—Fe | 55 | 20 | 0.03 | 9.0 | 105.4 |
| | 10 | 9.6Si—5.4Al—0.3Pt—Fe | 110 | 10 | 0.04 | 10.5 | 78.1 |
| | 11 | 9.2Si—5.6Al—1.5Y—Fe | 3 | — | 1.4 | 9.7 | 81.2 |
| | 12 | 9.0Si—5.0Al—1.0Y—0.8Ti—Fe | 4 | — | 1.3 | 10.5 | 88.8 |
| | 13 | 9.4Si—6.2Al—1.2Mo—Fe | 75 | 20 | 0.080 | 8.8 | 115.0 |
| | 14 | 8.9Si—7.05Al—1.2Mo—1.0Ni—Fe | 80 | 35 | 0.035 | 8.7 | 119.5 |
| | 15 | 8.9Si—6.95Al—1.2Mo—1.0Ni—Fe | 75 | 25 | 0.033 | 8.9 | 110.0 |
| Alloy of the present invention | 16 | 9.0Si—7.0Al—1.2Mo—1.0Ni—Fe | 60 | 34 | 0.045 | 8.5 | 109.2 |
| | 17 | 9.0Si—6.85Al—1.0Mo—1.0Ni—Fe | 113 | 50 | 0.026 | 9.1 | 110.9 |
| | 18 | 9.1Si—6.85Al—1.0Mo—1.0Ni—Fe | 74 | 37 | 0.028 | 8.9 | 104.9 |
| | 19 | 9.1Si—6.75Al—1.0Mo—1.0Ni—Fe | 155 | 70 | 0.018 | 8.6 | 99.7 |
| | 20 | 8.9Si—7.05Al—1.2Mo—1.0Ni—0.05Ca—Fe | 67 | 40 | 0.053 | 8.5 | 103.9 |
| | 21 | 8.9Si—7.05Al—1.2Mo—1.0Ni—O.1Ca—Fe | 64 | 50 | 0.062 | 8.4 | 102.7 |
| | 22 | 8.9Si—7.05Al—1.2Mo—1.0Ni—0.2Ca—Fe | 59 | 20 | 0.053 | 8.8 | 111.8 |

EXAMPLE 3

About 1 g of a thin strip of the present invention shown in the following Table 3, which was produced in the same manner as described in Example 1, was wound round an alumina ceramic bobbin having a diameter of about 20 mm, while applying electrically insulating MgO powders between successive windings of the strip, and then the wound thin strip was subjected to the same heat treatment as described in Example 2. Then, a measuring coil was wound round the thin strip, and the effective permeability μe of the thin strip, as a magnetic property under alternate current thereof, was measured at various frequencies to obtain a value shown in Table 3. For reference, effective permeabilities of conventional Fe-Ni series permalloy and Alperm series alloy produced by rolling and Sendust sheet cut out from cast Sendust are also shown in Table 3, which shows that the thin strips of the present invention have a high effective permeability particularly at a high frequency range.

TABLE 3

| | | Effective permeability | | | | | Thickness |
|---|---|---|---|---|---|---|---|
| Sample No. | Composition (wt %) | 250 Hz | 1 KHz | 10 KHz | 100 KHz | 500 KHz | (μm) |
| 17 | 9.0Si—6.85Al—1.0Mo—1.0Ni—Fe | 6,030 | 5,182 | 5,063 | 2,479 | 1,020 | 37 |

TABLE 3-continued

| Sample No. | Composition (wt %) | Effective permeability 250 Hz | 1 KHz | 10 KHz | 100 KHz | 500 KHz | Thickness (μm) |
|---|---|---|---|---|---|---|---|
| 18 | 9.1Si—6.85Al—1.0Mo—1.0Ni—Fe | 2,220 | 2,341 | 2,239 | 2,021 | 1,121 | 35 |
| | 77.5Ni—4.6Mo—3.5Cu—Fe | 40,000 | 35,000 | 3,000 | 2,000 | — | 100 |
| Conventional alloy | 81.0Ni—5.5Mo—Fe | 65,000 | 40,000 | 5,000 | 2,200 | — | 100 |
| | 16Al—Fe series Alperm | 3,200 | 2,700 | 1,500 | 600 | — | 100 |
| | 12Al—Fe series Alperm | — | 1,500 | 1,350 | 600 | — | 100 |
| | 9.6Si—5.4Al—Fe Sendust | — | 15,000 | — | 1,000 | — | 200 |

As described above, the thin strips of the present invention are higher in tensile strength and flexibility than the thin strips of conventional Sendust alloy and Sendust series alloy. Moreover, when the thin strips of the present invention are heat treated, the heat treated thin strips have substantially equal magnetic properties to those of the thin strip of Sendust alloy. Further, the thin strips of the present invention can be easily produced, and cores for a voltage or current transformer or a magnetic head can be produced from the thin strips.

INDUSTRIAL APPLICABILITY

The thin strips of the present invention can be used as magnetic materials having high permeability and particularly used as cores for a voltage or current transformer or a magnetic head of magnetic audio and video recording devices.

We claim:

1. A microcrystalline thin strip for magnetic material having high permeability which consists of 7.0–9.6% of Si, 5.5–7.5% of Al, 0.3–3.0% of Mo, 0.3–4.0% of Ni and the remainder being substantially Fe has a tensile strength of more than 35 kg/mm$^2$ and a bending fracture strain of more than $8\times10^{-3}$.

2. A microcrystalline thin strip for magnetic material having high permeability, a tensile strength of more than 35 kg/mm$^2$ and a bending rupture strain of more than $8\times10^{-3}$, which is obtained by ejecting a molten metal consisting of 7.0–9.6% of Si, 5.5–7.5% of Al, 0.3–3.0% of Mo, 0.3–4.0% of Ni, and the remainder being ssubstantially Fe onto the moving cooling surface of one or more cooling substances from a nozzle and quenching and solidifying the molten metal.

3. A method for producing a microcrystalline thin strip for magnetic material having high permeability, a tensile strength of more than 35 kg/mm$^2$ and a bending rupture strain of more than $8\times10^{-3}$, which comprises ejecting a molten metal consisting of 7.0–9.6% of Si, 5.5–7.5% of Al, 0.3–3.0% of Mo, 0.3–4.0% of Ni, 0–0.5% of Ca and the remainder being substantially Fe onto the moving cooling surface of one or more cooling substances from a nozzle and quenching and solidifying the molten metal.

4. A core for a voltage or current transformer manufactured from a microcrystalline thin strip for magnetic material having high permeability which consists of 7.0–9.6% of Si, 5.5–7.5% of Al, 0.3–3.0% of Mo, 0.3–4.0% of Ni, 0–0.5% of Ca and the remainder being substantially Fe and has a tensile strength of more than 35 kg/mm$^2$ and a bending fracture strain of more than $8\times10^{-3}$.

5. A magnetic head core manufactured from a microcrystalline thin strip for magnetic material having high permeability which consists of 7.0–9.6% of Si, 5.5–7.5% of Al, 0.3–3.0% of Mo, 0.3–4.0% of Ni, 0–0.5% of Ca and the remainder being substantially Fe and has a tensile strength of more than 35 kg/mm$^2$ and a bending fracture strain of more than $8\times10^{-3}$.

6. A microcrystalline thin strip for magnetic material having high permeability which consists of 7.0–9.6% of Si, 5.5–7.5% of Al, 0.3–3.0% of Mo, 0.3–4.0% of Ni, Ca which does not include O but includes not more than 0.5%, and the remainder being substantially Fe and has a tensile strength of more than 35 kg/mm$^2$ and a bending fracture strain of more than $8\times10^{-3}$.

7. A microcrystalline thin strip for magnetic material having high permeability, a tensile strength of more than 35 kg/mm$^2$ and a bending fracture strain of more than $8\times10^{-3}$, which is obtained by ejecting a molten metal consisting of 7.0–9.6% of Si, 5.5–7.5% of Al, 0.3–3.0% of Mo, 0.3–4.0% of Ni, Ca which does not include O but includes not more than 0.5%, and the remainder being substantially Fe onto the moving cooling surface of one or more cooling substances from a nozzle and quenching and solidifying the molten metal.

* * * * *